US007129773B2

(12) United States Patent
Ito et al.

(10) Patent No.: US 7,129,773 B2
(45) Date of Patent: Oct. 31, 2006

(54) BAND-GAP TYPE CONSTANT VOLTAGE GENERATING CIRCUIT

(75) Inventors: Masahiro Ito, Kanagawa (JP); Masafumi Tatewaki, Kanagawa (JP)

(73) Assignee: NEC Electronics Corporation, Kawasaki (JP)

( * ) Notice: Subject to any disclaimer, the term of this patent is extended or adjusted under 35 U.S.C. 154(b) by 70 days.

(21) Appl. No.: 10/967,287

(22) Filed: Oct. 19, 2004

(65) Prior Publication Data

US 2005/0083030 A1 Apr. 21, 2005

(30) Foreign Application Priority Data

Oct. 20, 2003 (JP) ..... 2003-359601

(51) Int. Cl.
*G05F 1/10* (2006.01)
*G05F 3/20* (2006.01)

(52) U.S. Cl. ..... 327/538; 327/561; 323/313; 323/277

(58) Field of Classification Search ..... 327/530–546, 327/334, 560, 561; 323/277–281, 311, 313; 307/601, 603
See application file for complete search history.

(56) References Cited

U.S. PATENT DOCUMENTS 5,428,687 A * 6/1995 Willcocks et al. ..... 381/18
6,815,998 B1 * 11/2004 Samad ..... 327/530

* cited by examiner

*Primary Examiner*—Rajnikant B. Patel
(74) *Attorney, Agent, or Firm*—McGinn IP Law Group, PLLC

(57) ABSTRACT

A band-gap type constant voltage generating circuit is produced in a semiconductor chip, and has a first potential terminal and a second potential terminal. A band-gap circuit includes first and second transistors having respective bases connected to each other, a first resistor connected between emitters of the first and second transistors, and a second resistor connected between the emitter of the second transistor and the first potential terminal. A constant voltage production circuit is provided between the first and second potential terminals to produce and output a constant voltage based on a base-emitter voltage of the second transistor of the band-gap circuit, and the constant voltage is fed as a feedback signal to the base of the second transistor of the band-gap circuit. A driver circuit is provided between the first and second potential terminals and connected to collectors of the first and second transistors to drive the band-gap circuit. The driver circuit is constituted such that an influence of absolute process fluctuation, to which the semiconductor chip is subjected during a production process thereof, is eliminated from the constant voltage.

21 Claims, 5 Drawing Sheets

$V_{CC}$
10
$V_{REF}$
14
12
$R_1$
$R_2$
$R_3$
$R_4$
$R_5$
$R_6$
$R_7$
$R_8$
$R_9$
$R_{10}$
$R_{11}$
$C_1$
$C_2$
$Q_0$
$Q_1$
$Q_2$
$Q_3$
$Q_4$
$Q_5$
$Q_6$
$Q_7$
$Q_8$
$Q_9$
$Q_{10}$
16
18
20
22
24
26

$V_{CC}$
10
$V_{REF}$
14
12
16
20
22
24
26
28
$R_5$
$R_6$
$R_7$
$R_8$
$R_9$
$R_{10}$
$R_{11}$
$R_{12}$
$R_{13}$
$R_1$
$R_2$
$C_1$
$C_2$
$Q_0$
$Q_1$
$Q_2$
$Q_5$
$Q_6$
$Q_7$
$Q_8$
$Q_9$
$Q_{10}$
$Q_{11}$
$Q_{12}$
$Q_{13}$
$Q_{14}$ $V_{CC}$
10
$V_{REF}$
14
12
16
20
22
24
26
28
30
32
$R_{12}$
$R_{13}$
$R_{14}$
$R_{15}$
$R_5$
$R_6$
$R_7$
$R_8$
$R_9$
$R_{10}$
$R_{11}$
$R_1$
$R_2$
$R_{16}$
$R_{17}$
$Q_{11}$
$Q_{12}$
$Q_{13}$
$Q_{14}$
$Q_{15}$
$Q_{16}$
$Q_{17}$
$Q_{18}$
$Q_5$
$Q_6$
$Q_7$
$Q_8$
$Q_9$
$Q_{10}$
$Q_0$
$Q_1$
$Q_2$
$Q_{19}$
$Q_{20}$
$C_1$
$C_2$ $V_{CC}$
10
$V_{REF}$
14
12
16
20
22
24
26
28
30
32
34
$R_5$
$R_6$
$R_7$
$R_8$
$R_9$
$R_{10}$
$R_{11}$
$R_{12}$
$R_{13}$
$R_{14}$
$R_{15}$
$R_{16}$
$R_{17}$
$R_{18}$
$R_{19}$
$R_1$
$R_2$
$Q_5$
$Q_6$
$Q_7$
$Q_8$
$Q_9$
$Q_{10}$
$Q_{11}$
$Q_{12}$
$Q_{13}$
$Q_{14}$
$Q_{15}$
$Q_{16}$
$Q_{17}$
$Q_{18}$
$Q_{19}$
$Q_{20}$
$Q_{21}$
$Q_{22}$
$Q_{23}$
$Q_{24}$
$Q_{25}$
$Q_0$
$Q_1$
$Q_2$
$C_1$
$C_2$ $V_{CC}$
10
$V_{REF}$
14
12
16
20
22
24
26
28
30
32
$R_{12}$
$R_{13}$
$R_{14}$
$R_{15}$
$R_5$
$R_6$
$R_7$
$R_8$
$R_9$
$R_{10}$
$R_{11}$
$R_1$
$R_2$
$R_{16}$
$R_{17}$
$Q_{11}$
$Q_{12}$
$Q_{13}$
$Q_{14}$
$Q_{15}$
$Q_{16}$
$Q_{17}$
$Q_{18}$
$Q_5$
$Q_6$
$Q_7$
$Q_8$
$Q_9$
$Q_{10}$
$Q_0$
$Q_{26}$
$Q_1$
$Q_2$
$Q_{19}$
$Q_{20}$
$C_1$
$C_2$

BAND-GAP TYPE CONSTANT VOLTAGE GENERATING CIRCUIT

BACKGROUND OF THE INVENTION

1. Field of the Invention

The present invention generally relates to a constant voltage generating circuit, and more particularly relates to a band-gap type constant voltage generating circuit produced in a semiconductor chip.

2. Description of the Related Art

Such a band-gap type constant voltage generating circuit is constituted such that a constant voltage is output by utilizing a difference of a potential drop (which is defined as a base-emitter voltage) in a P-N junction between a base and an emitter of a bipolar junction transistor. This band-gap type constant voltage generating circuit can output the constant voltage without being substantially influenced by variation in environmental temperature.

Nevertheless, the band-gap type constant voltage generating circuit is susceptible to variation in process conditions. When a plurality of semiconductor chips, each of which has a band-gap type constant voltage generating circuit, are processed and produced in a semiconductor wafer, such as a silicon wafer, various elements forming the band-gap type constant generating circuit are subjected to both an absolute process fluctuation and a relative process fluctuation due to the variation in the process conditions.

For example, when two elements, which are identical to each other, are processed and produced in a silicon wafer at locations remotely separated from each other, a variation between the produced elements is defined as the absolute process fluctuation. On the other hand, when two elements, which are identical to each other, are processed and produced in a silicon wafer at locations closed to each other, a variation between the produced elements is defined as the relative process fluctuation. In general, the absolute process fluctuation is on the order of ±20%, and the relative process fluctuation is on the order of ±2%.

Of course, the absolute process fluctuation should be eliminated before quality and reliance of the band-gap type constant voltage generating circuits can be improved. Nevertheless, the prior art band-gap type constant voltage generating circuits fail to eliminate the absolute process fluctuation, as discussed in detail hereinafter.

SUMMARY OF THE INVENTION

Therefore, an object of the present invention is to provide a constant voltage generating circuit produced in a semiconductor chip, which is constituted so as not to be susceptible to variation in process conditions.

In accordance with the present invention, there is provided a band-gap type constant voltage generating circuit produced in a semiconductor chip and having a first potential terminal and a second potential terminal. The band-gap type constant voltage generating circuit comprises: a band-gap circuit including first and second transistors having respective bases connected to each other, a first resistor connected between emitters of the first and second transistors, and a second resistor connected between the emitter of the second transistor and the first potential terminal; a constant voltage production circuit provided between the first and second potential terminals to produce and output a constant voltage based on a base-emitter voltage of the second transistor of the band-gap circuit, with the constant voltage being fed as a feedback signal to the base of the second transistor of the band-gap circuit; and a driver circuit provided between the first and second potential terminals and connected to collectors of the first and second transistors to drive the band-gap circuit. According to the present invention, the driver circuit is constituted such that an influence of absolute process fluctuation, to which the semiconductor chip is subjected during a production process thereof, is eliminated from the constant voltage.

The driver circuit may be formed by a current mirror circuit having an input terminal and an output terminal and connected to the first potential terminal, a first Wilson type current mirror circuit having an input terminal and an output terminal and connected to the second potential terminal, and a second Wilson type current mirror circuit having an input terminal and an output terminal and connected to the second potential terminal. The respective collectors of the first and second transistors of the band-gap circuit are connected to the input terminal of the first Wilson type current mirror circuit and the output terminal of the second Wilson type current mirror circuit, and the respective input and output terminals of the current mirror circuit are connected to the output terminal of the first Wilson type current mirror circuit and the input terminal of the second Wilson type current mirror circuit.

The current mirror circuit may include third and fourth transistors having respective bases connected to each other, a third resistor connected between the first potential terminal and an emitter of the third transistor, and a fourth resistor connected between the first potential terminal and an emitter of the fourth resistor. A collector of the third transistor forms the input terminal of the current mirror circuit, and a collector of the fourth transistor forms the output terminal of the current mirror circuit.

In this case, the constant voltage may be represented by the following equation:

$$V_{REF}=V_{BE}(Q_2)+[2\cdot R_2/R_1]dV_{BE}-2\cdot R_2\cdot I_C/h_{fe}$$

Herein: $V_{REF}$ is the constant voltage; $V_{BE}(Q_2)$ is the base-emitter voltage of the second transistor; $R_2$ is a resistance value of the second resistor; $R_1$ is a resistance value of the first resistor; $dV_{BE}$ is a difference between a base-emitter voltage of the first transistor and the base-emitter voltage of the second transistor; $I_C$ is a collector current of the first, second, third and fourth transistors; and $h_{fe}$ is a current amplification factor of the first, second, third and fourth transistors.

In this equation, the first member $V_{BE}(Q_2)$ is subjected to the influence of absolute process fluctuation. According to the present invention, the resistance value $R_2$ and the collector current $I_C$ are set such that the following equation is established:

$$V_{BE}(Q_2)=2\cdot R_2\cdot I_C/h_{fe}$$

Namely, the first member $V_{BE}(Q_2)$ is removed from the first-mentioned equation, and thus it is possible to eliminate the influence of absolute process fluctuation from the constant voltage.

An emitter junction area ratio of the third and fourth transistors of the current mirror circuit may be regulated to thereby vary the coefficient of the third member $R_2\cdot I_C/h_{fe}$ of the first-mentioned equation.

In this band-gap type constant voltage generating circuit, a coefficient-determination transistor may be provided between the collector of the first transistor of the band-gap circuit and the input terminal of the first Wilson type current mirror circuit. A collector of the coefficient-determination transistor is connected to the input terminal of the first Wilson type current mirror circuit, a base of the coefficient-determination transistor is connected to the collector of the second transistor of the band-gap circuit, and an emitter of the coefficient-determination transistor is connected to the collector of the second transistor of the band-gap circuit. When the coefficient-determination transistor is used, the constant voltage is represented by the following equation:

$$V_{REF}=V_{BE}(Q_2)+[2\cdot R_2/R_1]dV_{BE}-\alpha\cdot R_2\cdot I_C/h_{fe}$$

Herein: $V_{REF}$ is the constant voltage; $V_{BE}(Q_2)$ is the base-emitter voltage of the second transistor; $R_2$ is a resistance value of the second resistor; $R_1$ is a resistance value of the first resistor; $dV_{BE}$ is a difference between a base-emitter voltage of the first transistor and the base-emitter voltage of the second transistor; $I_C$ is a collector current of the first, second, third and fourth transistors; $h_{fe}$ is a current amplification factor of the first, second, third and fourth transistors, and $\alpha$ is a coefficient determined in dependence upon an emitter junction area of the coefficient-determination transistor.

In this case, the resistance value $R_2$ and the collector current $I_C$ are set such that the following equation is established:

$$V_{BE}(Q_2)=\alpha\cdot R_2\cdot I_C/h_{fe}$$

Namely, the first member $V_{BE}(Q_2)$ is removed from the first-mentioned equation, and thus it is possible to eliminate the influence of absolute process fluctuation from the constant voltage.

BRIEF DESCRIPTION OF THE DRAWINGS

The above object and other objects will be more clearly understood from the description set forth below, with reference to the accompanying drawings, wherein.

DESCRIPTION OF THE PREFERRED EMBODIMENTS

Before descriptions of an embodiment of the present invention, for better understanding of the present invention, a first prior art band-gap type constant voltage generating circuit will be explained with reference to FIG. 1.

This band-gap type constant voltage generating circuit is produced in a semiconductor chip (not shown), and is provided with a maximum potential terminal 10 to which a source voltage $V_{CC}$ is applied, a minimum potential terminal 12 which is grounded, and an output terminal 14 from which a constant voltage $V_{REF}$ is output.

Figure 1:
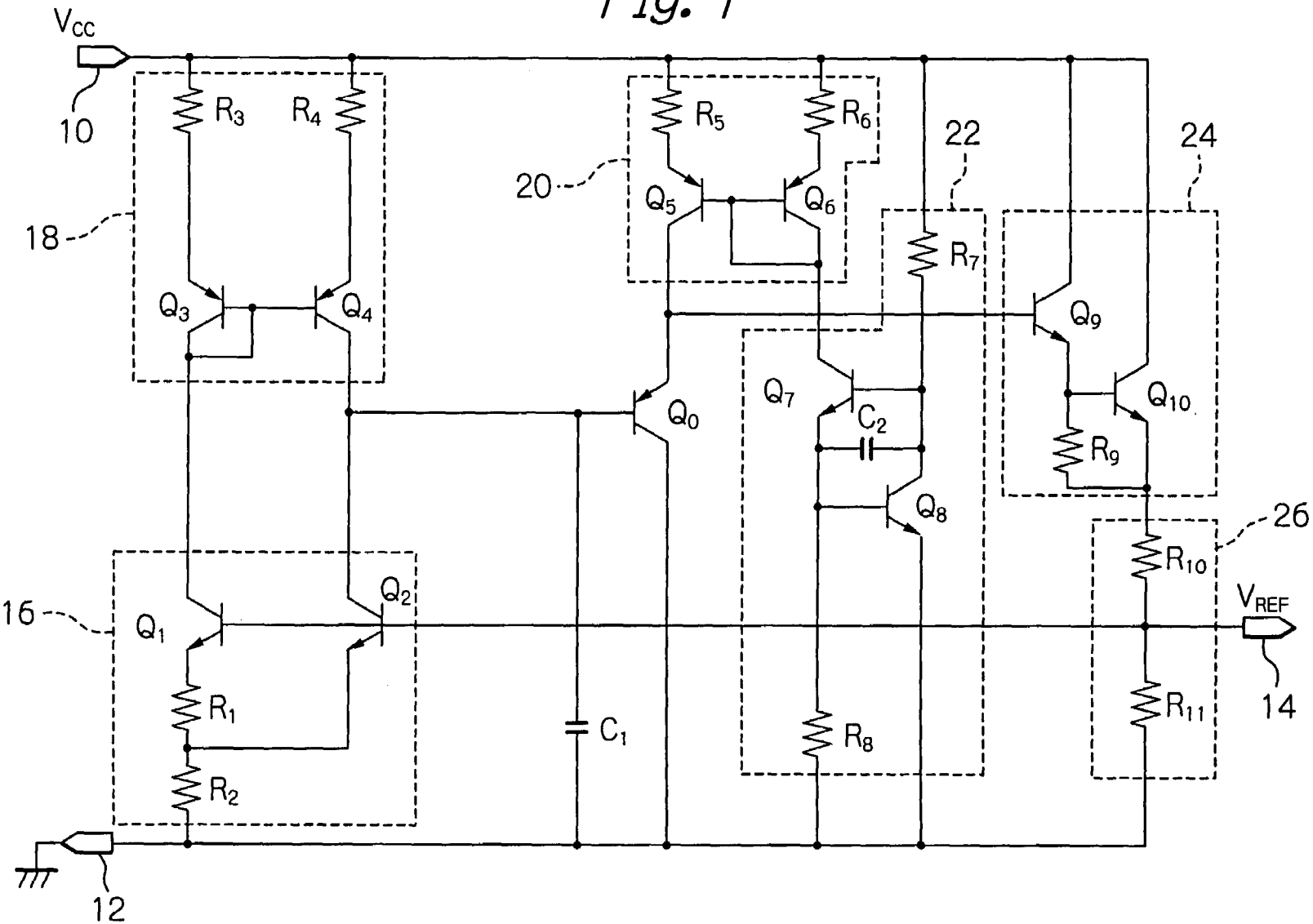
FIG. 1 is a wiring diagram of a first prior art band-gap type constant voltage generating circuit produced in a semiconductor chip.

As shown in FIG. 1, the constant voltage generating circuit includes a band-gap circuit 16, a current mirror circuit 18 for driving the band-gap circuit 16, a PNP type bipolar transistor $Q_0$ serving as an input transistor for receiving a voltage signal from the band-gap circuit 16, a current mirror circuit 20 for driving the input transistor $Q_0$, a current source circuit 22 for feeding a bias current to the current mirror circuit 20, a voltage level shift circuit 24 for receiving an emitter voltage signal from the input transistor $Q_0$, and a voltage divider circuit 26 for dividing a voltage from the voltage level shift circuit 24 to produce the constant voltage $V_{REF}$.

In particular, the band-gap circuit 16 has two NPN type bipolar transistors $Q_1$ and $Q_2$, and two resistors $R_1$ and $R_2$. The bases of the transistors $Q_1$ and $Q_2$ are connected to each other, and are then connected to the output terminal 14 to receive the constant voltage $V_{REF}$ from the voltage divider circuit 26 as a feedback signal. The emitter of the transistor $Q_1$ is connected to the minimum potential terminal 12 through the resistors $R_1$ and $R_2$ connected in series to each other, and the emitter of the transistor $Q_2$ is connected to the minimum potential terminal 12 through the resistor $R_2$. Note, in reality, the transistors $Q_1$ and $Q_2$ are of a common-base type.

The current mirror circuit 18 has two PNP type bipolar transistors $Q_3$ and $Q_4$, and two resistors $R_3$ and $R_4$. Both the transistors $Q_3$ and $Q_4$ are formed as common-base type transistors. The collector of the transistor $Q_3$ forms an input terminal of the current mirror circuit 18, and both the collector and the base of the transistor $Q_3$ are connected to the collector of the transistor $Q_1$ of the band-gap circuit 16. The collector of the transistor $Q_4$ forms an output terminal of the current mirror circuit 18, and is connected to the collector of the transistor $Q_1$, to thereby drive the band-gap circuit 16. The emitters of the transistors $Q_3$ and $Q_4$ are connected to the maximum potential terminal 10 through the respective resistors $R_3$ and $R_4$.

The base of the input transistor $Q_0$ is connected to the collector of the transistor $Q_2$ of the band-gap circuit 16, and receives a collector voltage of the transistor $Q_2$ as the aforesaid voltage signal. As shown in FIG. 1, the base of the input transistor $Q_0$ is connected to the minimum potential terminal 12 through a capacitor $C_1$, and the collector of the input transistor $Q_0$ is connected to the minimum potential terminal 12.

The current mirror circuit 20 has two PNP type bipolar transistors $Q_5$ and $Q_6$, and two resistors $R_5$ and $R_6$. Both the transistors $Q_5$ and $Q_6$ are formed as common-base type transistors. The collector of the transistor $Q_5$ forms an output terminal of the current mirror circuit 20, and is connected to the emitter of the input transistor $Q_0$. The collector of the transistor $Q_6$ forms an input terminal of the current mirror circuit 20, and both the collector and the base of the transistor $Q_6$ are connected to each other. The emitters of the transistors $Q_5$ and $Q_6$ are connected to the maximum potential terminal 10 through the respective resistors $R_5$ and $R_6$.

The current source circuit 22 has two NPN type bipolar transistors $Q_7$ and $Q_8$, a capacitor $C_2$, and two resistors $R_7$ and $R_8$. The collector of the transistor $Q_7$ is connected to the input terminal of the mirror current circuit 20, i.e. the collector of the transistor $Q_6$. The emitter of the transistor $R_7$ is connected to the base of the transistor $Q_8$, and is then connected to the minimum potential terminal 12 through the resistor $R_8$. Also, the emitter of the transistor $R_7$ is connected to the collector of the transistor $Q_8$ through the capacitor $C_2$. The collector of the transistor $Q_8$ is connected to the base of the transistor $Q_7$, and is then connected to the maximum potential terminal 10 through the resistor $R_7$. Also, the emitter of the transistor $Q_8$ is connected to the minimum potential terminal 12. Thus, the bias current is fed from the collector of the transistor $Q_7$ to the collector of the transistor $Q_6$, to thereby drive the current mirror circuit 20.

The voltage level shift circuit 24 is formed as a Darlington circuit having two NPN type transistors $Q_9$ and $Q_{10}$, and a resistor $R_9$. The emitter of the transistor $Q_9$ is connected to the base of the transistor $Q_{10}$, and is then connected to the emitter of the transistor $Q_{10}$ through the resistor $R_9$. Namely, each of the transistors $Q_9$ and $Q_{10}$ serves as an emitter follower. The collectors of the transistors $Q_9$ and $Q_{10}$ are connected to the maximum potential terminal 10. The base of the transistor $Q_9$ is connected to the emitter of the input transistor $Q_0$, to thereby receive the emitter voltage signal from the emitter of the input transistor $Q_0$.

The voltage divider circuit 26 has two resistors $R_{10}$ and $R_{11}$ connected in series to each other. One end of the resistor $R_{10}$ is connected to the emitter of the transistor $Q_{10}$, and the other end of the resistor $R_{10}$ is connected to one end of the resistor 11, with the other end of the resistor 11 being connected to the minimum potential terminal 12. A voltage, output from the emitter of the transistor $Q_{10}$, is divided by the resistors $R_{10}$ and $R_{11}$ and a divided voltage produced between the resistors $R_{10}$ and $R_{11}$ is output as the constant voltage $V_{REF}$ from the output terminal 14.

In short, the transistor $Q_{10}$, the current mirror circuit 20, the current source circuit 22, the voltage level shift circuit 24, and the voltage divider circuit 26 form a constant voltage production circuit for producing and outputting the constant voltage $V_{REF}$ based on a base-emitter voltage produced in the transistor $Q_2$ of the band-gap circuit 16.

Note, each, of the capacitors $C_1$ and $C_2$ serves as a phase-compensating capacitor for eliminating vibrations which may be involved in the band-gap constant voltage generating circuit by feeding the feedback signal ($V_{REF}$) from the voltage divider circuit 26 to the band-gap circuit 16.

In this first prior art constant voltage generating circuit, when the base-emitter voltage of the transistor $Q_2$ is defined as $V_{BE}(Q_2)$, and when a current flowing through the resistor $R_2$ is defined as $I(R_2)$, the constant voltage $V_{REF}$ is represented by the following equation:

$$V_{REF}=V_{BE}(Q_2)+R_2\cdot I(R_2) \tag{1}$$

Note, reference $R_2$ per se represents a resistance value of the resistor $R_2$.

Since the current $I(R_2)$ is the sum of a current flowing through the resistor $R_1$ and an emitter current of the transistor $Q_2$, the equation (1) may be transformed as follows:

$$V_{REF}=V_{BE}(Q_2)+R_2[I(R_1)+I_E(Q_2)] \tag{2}$$

Herein: $I(R_1)$ represents the current flowing through the resistor $R_1$; and $I_E(Q_2)$ represents the emitter current of the transistor $Q_2$. Note, reference $R_1$ per se represents a resistance value of the resistor $R_1$.

In order to further develop the equation (2), the emitter current $I_E(Q_2)$ of the band-gap circuit 16 is analyzed and determined as explained below.

First, an emitter current of the transistor $Q_1$ is equal to the current $I(R_1)$. Namely, $$I_E(Q_1)=I(R_1)$$

Herein: $I_E(Q_1)$ represents the emitter current of the transistor $Q_1$.

Also, when respective collector and base currents of the transistor $Q_1$ are defined as $I_C(Q_1)$ and $I_B(Q_1)$, the collector current $I_C(Q_1)$ is represented by as follows:

$$I_C(Q_1)=I_E(Q_1)-I_B(Q_1) \tag{3}$$

Herein: $I_C(Q_1)$ and $I_B(Q_1)$ represent the respective collector and base currents of the transistor $Q_1$.

Since the collector of the transistor $Q_1$ of the band-gap circuit 16 is connected to the input terminal of the current mirror circuit 18 (i.e., the collector of the transistor $Q_3$), an output current of the current mirror circuit 18 (i.e., the collector current of the transistor $Q_4$) is represented by using base currents of the transistors $Q_3$ and $Q_4$ as follows:

$$I_C(Q_4)=I_C(Q_1)-I_B(Q_4)-I_B(Q_3) \tag{4}$$

Herein: $I_C(Q_4)$ and $I_B(Q_4)$ represent the respective collector and base currents of the transistor $Q_4$; and $I_B(Q_3)$ represents the base current of the transistor $Q_3$.

Since the collector of the transistor $Q_4$ is connected to the collector of the transistor $Q_2$, a collector current of the transistor $Q_2$ is equal to the collector current $I_C(Q_4)$ of the transistor $Q_4$. Namely, $$I_C(Q_2)=I_C(Q_4) \tag{5}$$

Herein: $I_C(Q_2)$ represents the collector current of the transistor $Q_2$. Note, a base current of the input transistor $Q_0$ is negligible.

Since the emitter current $I_E(Q_2)$ of the transistor $Q_2$ of the band-gap circuit 16 is equal to an addition of a base current of the transistor $Q_2$ to the collector current $I_C(Q_2)$ of the transistor $Q_2$, it is represented by the following equation:

$$I_E(Q_2)=I_C(Q_2)+I_B(Q_2) \tag{6}$$

Herein: $I_B(Q_2)$ represents the base current of the transistor $Q_2$.

Thus, by using the equations (5), (4) and (3) in order, the equation (6) may be transformed as follows:

$$\begin{aligned} I_E(Q_2) &= I_C(Q_4)+I_B(Q_2) \\ &= I_C(Q_1)-I_B(Q_4)-I_B(Q_3)+I_B(Q_2) \\ &= I_E(Q_1)-I_B(Q_1)-I_B(Q_4)-I_B(Q_3)+I_B(Q_2) \end{aligned} \tag{7}$$

Accordingly, the aforesaid equation (2) may be rewritten as follows:

$$V_{REF}=V_{BE}(Q_2)+R_2[2\cdot I(R_1)-I_B(Q_1)-I_B(Q_4)-I_B(Q_3)+I_B(Q_2)] \tag{8}$$

In the band-gap circuit 16, when a base-emitter voltage of the transistor $Q_1$ is defined as $V_{BE}(Q_1)$, the current $I(R_1)$ is represented by using the base-emitter voltages $V_{BE}(Q_1)$ and $V_{BE}(Q_2)$ of the transistors $Q_1$ and $Q_2$ as follows:

$$I(R_1)=[V_{BE}(Q_1)-V_{BE}(Q_2)]/R_1 \tag{9}$$

When the difference $[V_{BE}(Q_1)-V_{BE}(Q_2)]$ is defined as $dV_{BE}$, the equation (8) may be transformed by using the equation (9) as follows:

$$\begin{aligned} V_{REF} &= V_{BE}(Q_2)+2\cdot R_2\cdot I(R_1)-R_2[I_B(Q_1)+ \\ &\quad I_B(Q_4)+I_B(Q_3)-I_B(Q_2)] \\ &= V_{BE}(Q_2)+2\cdot R_2[V_{BE}(Q_1)-V_{BE}(Q_2)]/R_1- \\ &\quad R_2[I_B(Q_1)+I_B(Q_4)+I_B(Q_3)-I_B(Q_2)] \\ &= V_{BE}(Q_2)+2\cdot R_2\cdot dV_{BE}/R_1-R_2[I_B(Q_1)+I_B(Q_4)+ \end{aligned} \tag{10}$$

-continued $$I_B(Q_3) - I_B(Q_2)]$$

As already stated hereinbefore, the various elements forming the band-gap type constant generating circuit are subjected to both an absolute process fluctuation (±20%) and a relative process fluctuation (±2%) due to variation in the process conditions under which the band-gap type constant generating circuit is processed and produced.

In this connection, when examining and considering the equation (10), it is found that the first member $V_{BE}(Q_2)$ is influenced by the absolute process fluctuation (±20%), the second member $2 \cdot R_2 \cdot dV_{BE}/R_1$ is influenced by the relative process fluctuation (±2%), and the third member $R_2[I_B(Q_1)+I_B(Q_4)+I_B(Q_3)-I_B(Q_2)]$ is influenced by the absolute process fluctuation (±20%). Especially, since the third member includes the sub-members $I_B(Q_1)$, $I_B(Q_4)$, $I_B(Q_3)$ and $I_B(Q_2)$ based on the respective base currents of the NPN type and PNP type bipolar transistors $Q_1$, $Q_2$, $Q_3$ and $Q_4$, the influence of the absolute process fluctuation (±20%) on the third member is considerably large.

Accordingly, the aforesaid first prior art band-gap type constant voltage generating circuit features inferior quality and reliance.

Next, a second prior art band-gap type constant voltage generating circuit will be explained with reference to FIG. 2.

This second prior art band-gap type constant voltage generating circuit is also produced in a semiconductor chip, and is substantially identical to the first prior art band-gap type constant voltage generating circuit except that a Wilson type current mirror circuit 28 is substituted for the current mirror circuit 18. Note, in FIG. 2, the same references as in FIG. 1 represent the same features.

Figure 2:
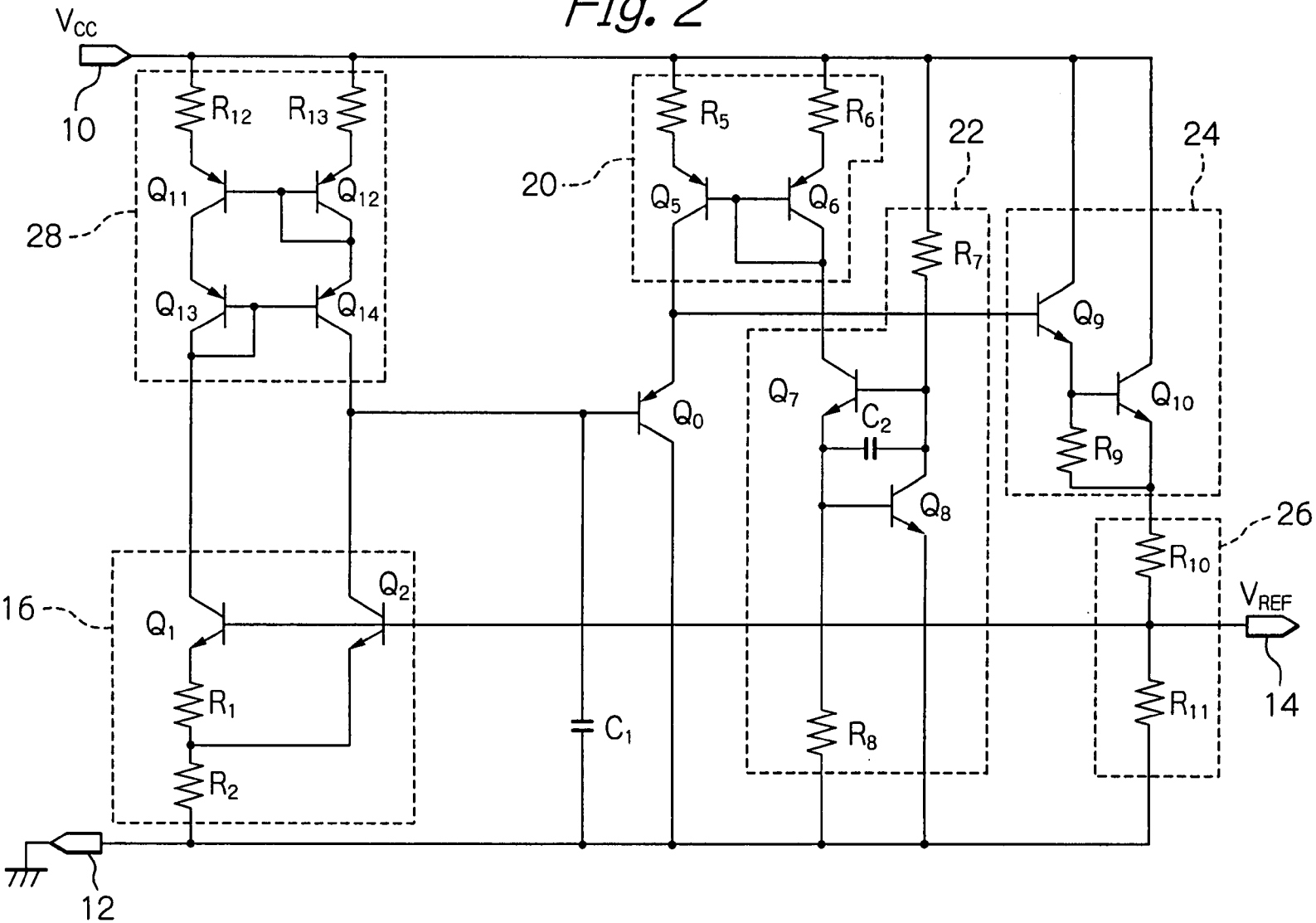
FIG. 2 is a wiring diagram of a second prior art band-gap type constant voltage generating circuit produced in a semiconductor chip.

As shown in FIG. 2, the Wilson type current mirror circuit 28 has four PNP type bipolar transistors $Q_{11}$, $Q_{12}$, $Q_{13}$ and $Q_{14}$, and two resistors $R_{12}$ and $R_{13}$. Both the transistors $Q_{11}$ and $Q_{12}$ are formed as common-base type transistors, and both the transistors $Q_{13}$ and $Q_{14}$ are formed as common-base type transistors. The emitters of the transistors $Q_{11}$ and $Q_{12}$ are connected to the maximum potential terminal 10 through the respective resistors $R_{12}$ and $Q_{13}$. The collector of the transistor $Q_{11}$ is connected to the emitter of the transistor $Q_{13}$. The collector of the transistor $Q_{13}$ forms an input terminal of the Wilson type current mirror circuit 28, and both the collector and the base of the transistor $Q_{13}$ are connected to the collector of the transistor $Q_1$ of the band-gap circuit 16, to thereby drive the band-gap circuit 16. Both the collector and the base of the transistor $Q_{12}$ are connected to the emitter of the transistor $Q_{14}$. The collector of the transistor $Q_{14}$ forms an output terminal of the Wilson type current mirror circuit 28, and is connected to the collector of the transistor $Q_2$ of the band-gap circuit 16.

In the Wilson type current mirror circuit 28, since the base current of each of the PNP type bipolar transistors $Q_{11}$, $Q_{12}$, $Q_{13}$ and $Q_{14}$ can be regarded as substantially zero, the collector currents $I_C(Q_1)$ and $I_C(Q_2)$ of the transistors $Q_1$ and $Q_2$ of the band-gap circuit 16 are equal to each other ($I_C(Q_1)=I_C(Q_2)$), and thus the base currents $I_B(Q_1)$ and $I_B(Q_2)$ of the transistors $Q_1$ and $Q_2$ are also equal to each other (($I_C(Q_1)=I_C(Q_2)$).

Accordingly, the emitter current $I_E(Q_2)$ of the transistor $Q_2$ is equal to the current $I(R_1)$ as shown in the following equation:

$$I_E(Q_2)=I_C(Q_2)+I_B(Q_2)=I_C(Q_1)+I_B(Q_1)=I(R_1)$$

Therefore, in the second prior art band-gap type constant voltage generating circuit, the constant voltage $V_{REF}$ is represented by the following equation:

$$\begin{aligned} V_{REF} &= V_{BE}(Q_2) + R_2[I(R_1) + I_E(Q_2)] \\ &= V_{BE}(Q_2) + 2 \cdot R_2 \cdot I(R_1) \\ &= V_{BE}(Q_2) + 2 \cdot R_2[V_{BE}(Q_1) - V_{BE}(Q_2)]/R_1 \\ &= V_{BE}(Q_2) + 2 \cdot R_2 \cdot dV_{BE}/R_1 \end{aligned} \tag{11}$$

The equation (11) corresponds to the aforesaid equation (10), from which the third member $R_2[I_B(Q_1)+I_B(Q_4)+I_B(Q_3)-I_B(Q_2)]$ is removed.

Accordingly, in the second prior art band-gap type constant voltage generating circuit, it is possible to eliminate the influence of the absolute process fluctuation (±20%), based on the base currents of the NPN type and PNP type bipolar transistors ($Q_1$, $Q_2$, $Q_{13}$ and $Q_{14}$), from the output constant voltage $V_{REF}$.

Nevertheless, the equation (11) still includes the first member $V_{BE}(Q_2)$ influenced by the absolute process fluctuation (±20%). Thus, it is impossible to use the second prior art band-gap type constant voltage generating circuit to feed a reference voltage to a high precise comparator, in which fluctuation of several percent is required in the reference voltage.

The present invention aims at completely eliminating the influence of the absolute process fluctuation (±20%) from the output constant voltage $V_{REF}$ in the aforesaid prior art band-gap type constant voltage generating circuits.

First Embodiment

Figure 3:
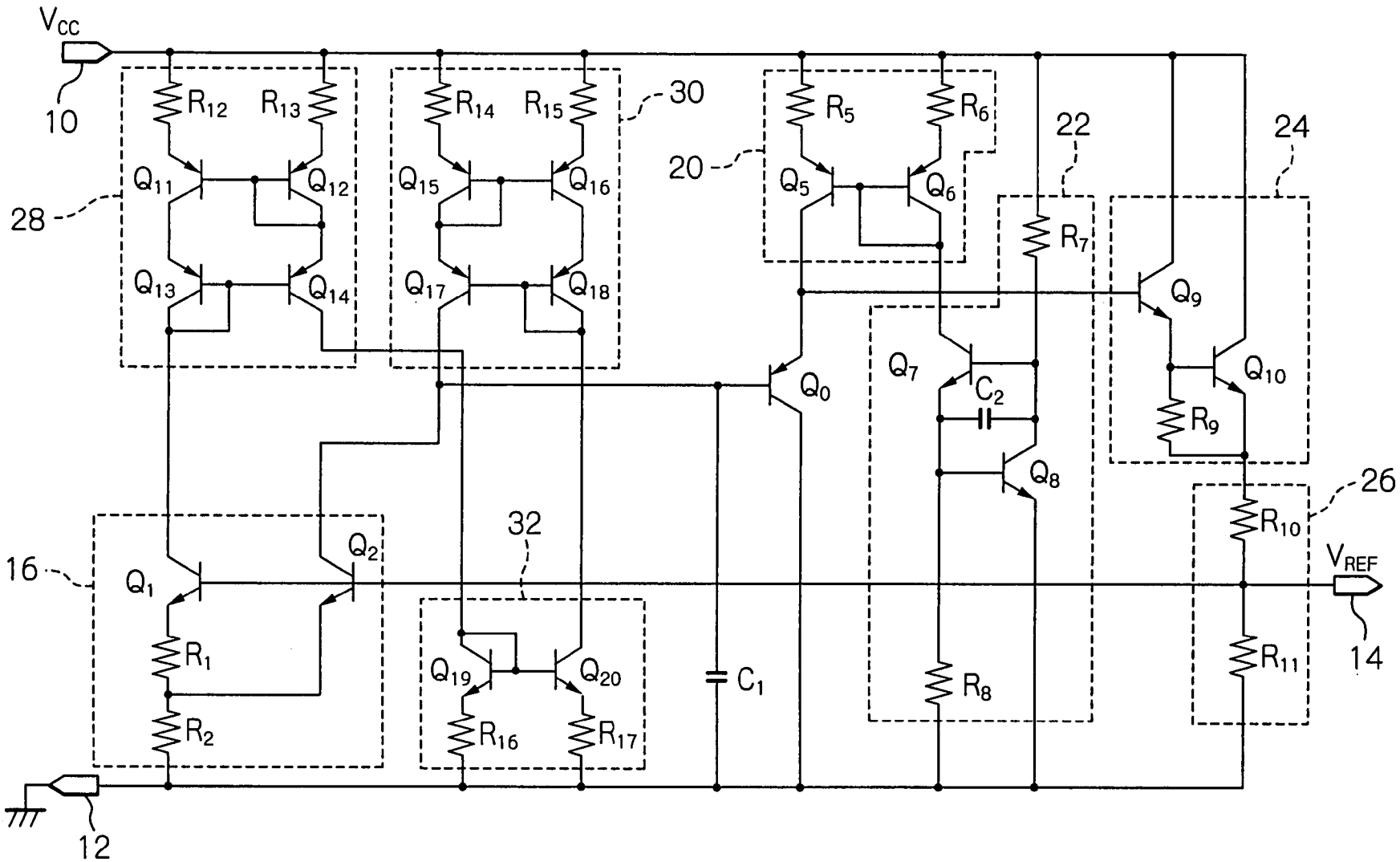
FIG. 3 is a wiring diagram of a first embodiment of a band-gap type constant voltage generating circuit according to the present invention.

With reference to FIG. 3, a first embodiment of a band-gap type constant voltage generating circuit according to the present invention will be now explained below.

As is apparent from FIG. 3, the first embodiment corresponds to the second prior art band-gap type constant voltage generating circuit to which a Wilson type current mirror circuit 30 and a current mirror circuit 32 are added. Note, in FIG. 3, the same references as in FIG. 2 represent the same features.

In the second prior art band-gap type constant voltage generating circuit shown in FIG. 2, the Wilson type current mirror circuit 28 is provided for driving the band-gap circuit 16. However, in the first embodiment shown in FIG. 3, the band-gap circuit 16 is driven by the Wilson type current mirror circuits 28 and 30 and the current mirror circuit 32. Namely, the Wilson type current mirror circuits 28 and 30 and the current mirror circuit 32 form a driver circuit for the band-gap circuit 16.

The Wilson type current mirror circuit 30 has four PNP type bipolar transistors $Q_{15}$, $Q_{16}$, $Q_{17}$ and $Q_{18}$, and two resistors $R_{14}$ and $R_{15}$. Both the transistors $Q_{15}$ and $Q_{16}$ are formed as common-base type transistors, and both the transistors $Q_{17}$ and $Q_{18}$ are formed as common-base type transistors. The emitters of the transistors $Q_{14}$ and $Q_{15}$ are connected to the maximum potential terminal 10 through the respective resistors $R_{14}$ and $Q_{15}$. Both the collector and the base of the transistor $Q_{15}$ are connected to the emitter of the transistor $Q_{17}$. The collector of the transistor $Q_{17}$ forms an output terminal of the Wilson type current mirror circuit 30, and is connected to the collector of the transistor $Q_2$, to thereby drive the band-gap circuit 16. The collector of the transistor $Q_{16}$ is connected to the emitter of the transistor $Q_{18}$. The collector of the transistor $Q_{18}$ forms an output terminal of the Wilson type current mirror circuit 30, and both the collector and the base of the transistor $Q_{18}$ are connected to each other.

The current mirror circuit 32 has two PNP type bipolar transistors $Q_{19}$ and $Q_{20}$, and two resistors $R_{16}$ and $R_{17}$. Both the transistors $Q_{19}$ and $Q_{20}$ are formed as common-base type transistors. The emitters of the transistors $Q_{19}$ and $Q_{20}$ are connected to the minimum potential terminal 12 through the respective resistors $R_{16}$ and $R_{17}$. The collector of the transistor $Q_{19}$ forms an input terminal of the current mirror circuit 32, and both the collector and the base of the transistor $Q_{19}$ are connected to the output terminal of the Wilson type current mirror circuit 28 (i.e., the collector of the transistor $Q_{14}$) to thereby drive the current mirror circuit 32. The collector of the transistor $Q_{19}$ forms an output terminal of the current mirror circuit 32, and is connected to the input terminal of the Wilson type current mirror circuit 30 (i.e., the collector of the transistor $Q_{18}$) to thereby drive the Wilson type current mirror circuit 30.

Similar to the above-mentioned prior art band-gap constant voltage generating circuit, in the first embodiment of the present invention, the constant voltage $V_{REF}$ is determined by a base-emitter voltage of the transistor $Q_2$ and a current flowing through the resistor $R_2$. Namely, the constant voltage $V_{REF}$ is represented by the following equation:

$$V_{REF}=V_{BE}(Q_2)+R_2\cdot I(R_2) \tag{12}$$

Herein: $V_{BE}(Q_2)$ represents the base-emitter voltage of the transistor $Q_2$; and $I(R_2)$ represents the current flowing through the resistor $R_2$. Note, reference $R_2$ per se represents a resistance value of the resistor $R_2$.

Since the current $I(R_2)$ is the sum of a current flowing through the resistor $R_1$ and an emitter current of the transistor $Q_2$, the equation (12) may be transformed as follows:

$$V_{REF}=V_{BE}(Q_2)+R_2[I(R_1)+I_E(Q_2)] \tag{13}$$

Herein: $I(R_1)$ represents the current flowing through the resistor $R_1$; and $I_E(Q_2)$ represents the emitter current of the transistor $Q_2$. Note, reference $R_1$ per se represents a resistance value of the resistor $R_1$.

In order to further develop the equation (13), the emitter current $I_E(Q_2)$ is analyzed and determined as explained below.

First, an emitter current of the transistor $Q_1$ is equal to the current $I(R_1)$. Namely, $$I_E(Q_1)=I(R_1) \tag{14}$$

Herein: $I_E(Q_1)$ represents the emitter current of the transistor $Q_1$.

Also, when respective collector and base currents of the transistor $Q_1$ are defined as $I_C(Q_1)$ and $I_B(Q_1)$, the collector current $I_C(Q_1)$ is represented by as follows:

$$I_C(Q_1)=I_E(Q_1)-I_B(Q_1) \tag{15}$$

Herein: $I_C(Q_1)$ and $I_B(Q_1)$ represent the respective collector and base currents of the transistor $Q_1$.

Since the collector of the transistor $Q_1$ of the band-gap circuit 16 is connected to the input terminal of the Wilson type current mirror circuit 28 (i.e., the collector of the transistor $Q_{13}$), an output current of the Wilson type current mirror circuit 28 (i.e., a collector current of the transistor $Q_{14}$) is equal to the collector current $I_C(Q_1)$ of the transistor $Q_1$. Namely, $$I_C(Q_{14})=I_C(Q_1) \tag{16}$$

Herein: $I_C(Q_{14})$ represents the collector of the transistor $Q_{14}$.

Since the collector of the transistor $Q_{14}$ is connected to the collector of the transistor $Q_{19}$ of the current mirror circuit 32, an output current of the current mirror circuit 32 (i.e., a collector current of the transistor $Q_{20}$) is smaller than the collector current $I_C(Q_{14})$ of the transistor $Q_{14}$ by the sum of base currents of the transistors $Q_{19}$ and $Q_{20}$. Namely, the collector current of the transistor $Q_{20}$ is represented by the following equation:

$$I_C(Q_{20})=I_C(Q_{14})-I_B(Q_{19})-I_B(Q_{20}) \tag{17}$$

Herein: $I_C(Q_{20})$ represents the collector current of the transistor $Q_{20}$; and $I_B(Q_{19})$ and $I_B(Q_{20})$ represent the respective base currents of the transistors $Q_{19}$ and $Q_{20}$.

Since the collector of the transistor $Q_{20}$ is connected to the input terminal of the Wilson type current mirror circuit 30 (i.e., the collector of the transistor $Q_{18}$), an output current of the Wilson type current mirror circuit 30 (i.e., a collector current of the transistor $Q_{17}$) is equal to the collector current $I_C(Q_{20})$ of the transistor $Q_{20}$ of the current mirror circuit 32. Namely, $$I_C(Q_{17})=I_C(Q_{20}) \tag{18}$$

Herein: $I_C(Q_{17})$ represents the collector current of the transistor $Q_{17}$.

Since the collector of the transistor $Q_{17}$ is connected to the collector of the transistor $Q_2$ of the band-gap circuit 16, a collector current of the transistor $Q_2$ is equal to the collector current $I_C(Q_{17})$ of the transistor $Q_{17}$ provided that a base current of the input transistor $Q_0$ is negligible. Namely, $$I_C(Q_2)=I_C(Q_{17}) \tag{19}$$

Herein: $I_C(Q_2)$ represents the collector current of the transistor $Q_2$.

When a base current of the transistor $Q_2$ of the band-gap circuit 16 is defined as $I_B(Q_2)$, the emitter current $I_E(Q_2)$ of the transistor $Q_2$ is equal to the sum of the collector and base currents $I_C(Q_2)$ and $I_B(Q_2)$ of the transistor $Q_2$. Namely, $$I_E(Q_2)=I_C(Q_2)+I_B(Q_2) \tag{20}$$

Thus, the equation (20) may be transformed by using the equations (19), (18), (17), (16), (15) and (14) in order as follows:

$$\begin{aligned} I_E(Q_2) &= I_C(Q_{17})+I_B(Q_2) \\ &= I_C(Q_{20})+I_B(Q_2) \\ &= I_C(Q_{14})-I_B(Q_{19})-I_B(Q_{20})+I_B(Q_2) \\ &= I_C(Q_1)-I_B(Q_{19})-I_B(Q_{20})+I_B(Q_2) \\ &= I_E(Q_1)-I_B(Q_1)-I_B(Q_{19})-I_B(Q_{20})+I_B(Q_2) \\ &= I(R_1)-I_B(Q_1)-I_B(Q_{19})-I_B(Q_{20})+I_B(Q_2) \end{aligned} \tag{21}$$

When size ratios of the transistors $Q_1$, $Q_2$, $Q_{19}$ and $Q_{20}$ (i.e., ratios of the emitter junction areas of these transistors) are 1:1:1:1, the base currents $I_B(Q_1)$, $I_B(Q_2)$, $I_B(Q_{19})$ and $I_B(Q_{20})$ can be regarded as being equal to each other, because the respective base currents are sufficiently small in comparison with the collector currents of the transistors $Q_1$, $Q_2$, $Q_{19}$ and $Q_{20}$. Note, in general, an NPN type bipolar transistor features a base current ($I_B(Q_1)$, $I_B(Q_2)$, $I_B(Q_{19})$, $I_B(Q_{20})$) which is in a range from 1/30 to 1/200 of a collector current thereof.

Thus, when each of the base $I_B(Q_1)$, $I_B(Q_2)$, $I_B(Q_{19})$ and $I_B(Q_{20})$, which can be regarded as being equal to each other, is defined as $I_B$, the equation (21) may be transformed as follows:

$$I_E(Q_2)=I(R_1)-2\cdot I_B \tag{22}$$

Accordingly, by using the equation (22), the aforesaid equation (13) may be rewritten as follows:

$$\begin{aligned} V_{REF} &= V_{BE}(Q_2)+R_2[I(R_1)+I(R_1)-2\cdot I_B] \\ &= V_{BE}(Q_2)+2\cdot R_2[I(R_1)-I_B] \end{aligned} \tag{23}$$

In the band-gap circuit 16, when a base-emitter voltage of the transistor $Q_1$ is defined as $V_{BE}(Q_1)$, the current $I(R_1)$ is represented by using the base-emitter voltages $V_{BE}(Q_1)$ and $V_{BE}(Q_2)$ of the transistors $Q_1$ and $Q_2$ as follows:

$$I(R_1)=[V_{BE}(Q_1)-V_{BE}(Q_2)]/R_1 \tag{24}$$

When the difference $[V_{BE}(Q_1)-V_{BE}(Q_2)]$ is defined as $dV_{BE}$, the equation (23) may be transformed by using the equation (24) as follows:

$$\begin{aligned} V_{REF} &= V_{BE}(Q_2)+2\cdot R_2[I(R_1)-I_B] \\ &= V_{BE}(Q_2)+2\cdot R_2[[V_{BE}(Q_1)-V_{BE}(Q_2)]/R_1-I_B] \\ &= V_{BE}(Q_2)+[2\cdot R_2/R_1]dV_{BE}-2\cdot R_2\cdot I_B \end{aligned} \tag{25}$$

In the first embodiment shown in FIG. 3, the collector currents of the transistors $Q_1$, $Q_2$, $Q_{19}$ and $Q_{20}$ can be regarded as being equal to each other. Thus, when each of the collector currents of the transistors $Q_1$, $Q_2$, $Q_{19}$ and $Q_{20}$ is defined as $I_C$, the following relationship is established between the collector current $I_C$ and the base current $I_B$:

$$I_C=h_{fe}\cdot I_B \tag{26}$$

Herein: $h_{fe}$ represents a current amplification factor of the transistors $Q_1$, $Q_2$, $Q_{19}$ and $Q_{20}$.

Accordingly, by using the equation (26), the equation (25) may be further transformed as follows:

$$V_{REF}=V_{BE}(Q_2)+[2\cdot R_2/R_1]dV_{BE}-2\cdot R_2\cdot I_C/h_{fe} \tag{27}$$

In general, in a transistor ($Q_1$, $Q_2$, $Q_{19}$, $Q_{20}$), there is a linear inversely proportional relationship between a current amplification factor ($h_{fe}$) and a base-emitter voltage. Thus, it is possible to suitably set the resistance value $R_2$ and the collector current $I_C$ such that the following equation is established:

$$V_{BE}(Q_2)=2\cdot R_2\cdot I_C/h_{fe} \tag{28}$$

Namely, when the establishment of the equation (28) is carried by suitably setting the resistance value $R_2$ and the collector current $I_c$, the first member $V_{BE}(Q_2)$ influenced by the absolute process fluctuation (±20%) can be removed from the equation (27). Thus, it is possible to completely eliminate the influence of the absolute process fluctuation (±20%) from the output constant voltage $V_{REF}$ in the band-gap type constant voltage generating circuit shown in FIG. 3.

Second Embodiment

Figure 4:
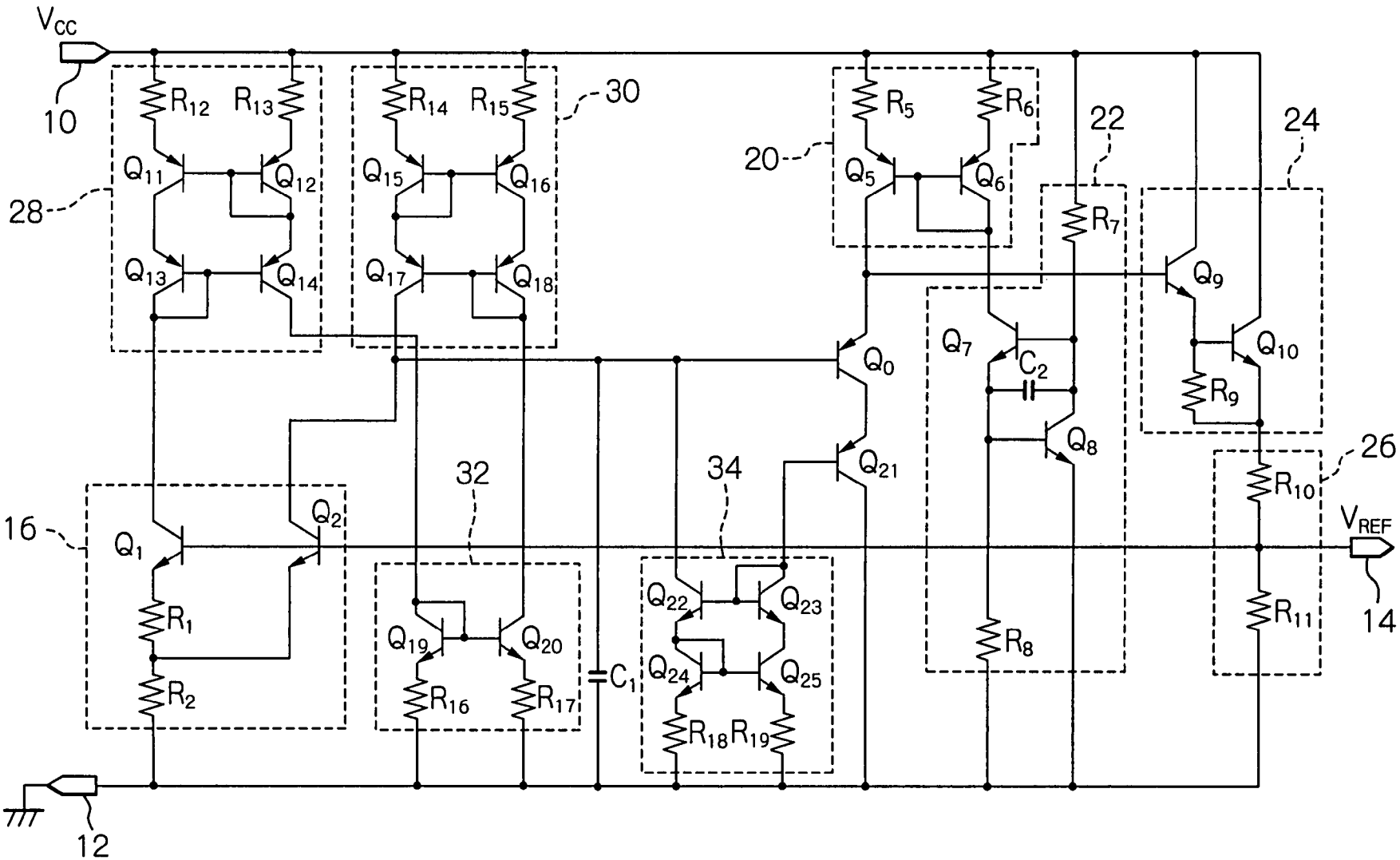
FIG. 4 is a wiring diagram of a second embodiment of the band-gap type constant voltage generating circuit according to the present invention.

With reference to FIG. 4, a second embodiment of the band-gap type constant voltage generating circuit according to the present invention will be now explained below.

As is apparent from FIG. 4, the second embodiment corresponds to the first embodiment to which a PNP type bipolar transistor $Q_{21}$ and a Wilson type current mirror circuit 34 are further added. Note, in FIG. 4, the same references as in FIG. 3 represent the same features.

In the above-mentioned first embodiment, although an influence, caused by the base current of the input PNP type bipolar transistor $Q_0$, is neglected, in this second embodiment, that influence is taken into consideration. Namely, the transistor $Q_{21}$ and the Wilson type current mirror circuit 34 are provided to eliminate the influence, caused by the base current of the input transistor $Q_0$, from the output constant voltage $V_{REF}$.

As is apparent from FIG. 4, the transistor $Q_{21}$ features the same polarity type as that of the input transistor $Q_0$, and is associated with the transistor $Q_0$ as an additional transistor. The emitter of the additional transistor $Q_{21}$ is connected to the collector of the input transistor $Q_0$, and the collector of the additional transistor $Q_{21}$ is connected to the minimum potential terminal 12.

The Wilson type current mirror circuit 34 has four NPN type bipolar transistors $Q_{22}$, $Q_{23}$, $Q_{24}$ and $Q_{25}$, and two resistors $R_{18}$ and $R_{19}$. Both the transistors $Q_{22}$ and $Q_{23}$ are formed as common-base type transistors, and both the transistors $Q_{24}$ and $Q_{25}$ are formed as common-base type transistors. The collector of the transistor $Q_{22}$ forms an output terminal of the Wilson type current mirror circuit 34, and is connected to the base of the input transistor $Q_0$. The collector of the transistor $Q_{23}$ forms an input terminal of the Wilson type current mirror circuit 34, and both the collector and the base of the input transistor $Q_0$ is connected to the base of the additional transistor $Q_{21}$. The emitter of the transistor $Q_{22}$ is connected to both the collector and the base of the transistor $Q_{24}$, and the emitter of the transistor $Q_{23}$ is connected to the collector of the transistor $Q_{25}$. Both the collectors of the transistors $Q_{24}$ and $Q_{25}$ are connected to the minimum potential terminal 12 through the respective resistors $R_{18}$ and $R_{19}$.

As stated above, in the second embodiment, the influence, caused by the base current of the input transistor $Q_0$, is taken into consideration. Thus, when the base current of the input transistor $Q_0$ is defined as $I_B(Q_0)$, the emitter current $I_E(Q_2)$ of the transistor $Q_2$ Of the band-gap circuit 16 is represented by the following equation:

$$\begin{aligned} I_E(Q_2) &= I_C(Q_2)+I_B(Q_2) \\ &= I_C(Q_{17})+I_B(Q_0)+I_B(Q_2) \\ &= I_C(Q_{20})+I_B(Q_0)+I_B(Q_2) \\ &= I_C(Q_{14})-I_B(Q_{19})-I_B(Q_{20})+I_B(Q_0)+I_B(Q_2) \\ &= I_C(Q_1)-I_B(Q_{19})-I_B(Q_{20})+I_B(Q_0)+I_B(Q_2) \\ &= I_E(Q_1)-I_B(Q_1)-I_B(Q_{19})-I_B(Q_{20})+I_B(Q_0)+I_B(Q_2) \\ &= I(R_1)-I_B(Q_1)-I_B(Q_{19})-I_B(Q_{20})+I_B(Q_0)+I_B(Q_2) \end{aligned} \tag{29}$$

Similar to the above-mentioned first embodiment, the base currents $I_B(Q_1)$, $I_B(Q_2)$, $I_B(Q_{19})$ and $I_B(Q_{20})$ can be regarded as being equal to each other. Thus, when each of the base $I_B(Q_1)$, $I_B(Q_2)$ $I_B(Q_{19})$ and $I_B(Q_{20})$ is defined as $I_B$, the equation (29) may be transformed as follows:

$$I_E(Q_2)=I(R_1)-2\cdot I_B+I_B(Q_0) \tag{30}$$

Accordingly, in the second embodiment, by using the equations (13), (24) and (30), the output constant voltage $V_{REF}$ is represented by the following equation:

$$V_{REF}=V_{BE}(Q_2)+[2\cdot R_2/R_1]dV_{BE}-R_2[2\cdot I_B-I_B(Q_0)] \quad (31)$$

The transistors $Q_0$ and $Q_{21}$ feature substantially the same characteristic as each other, and thus collector currents of the transistors $Q_0$ and $Q_{21}$ can be regarded as being equal to each other. Namely, when the respective collector currents of the transistors $Q_0$ and $Q_{21}$ are defined as $I_C(Q_0)$ and $I_C(Q_{21})$, $I_C(Q_0)=I_C(Q_{21})$. Also, when respective base currents of the transistors $Q_0$ and $Q_{21}$ are defined as $I_B(Q_0)$ and $I_B(Q_{21})$, the base currents $I_B(Q_0)$ $(=I_C(Q_0)/h_{fe})$ and $I_B(Q_{21})$ $(=I_C(Q_{21})/h_{fe})$ are substantially equal to each other.

As already stated, since the base of the additional transistor $Q_{21}$ is connected to the input terminal of the Wilson type current mirror circuit 34 (i.e., the collector of the transistor $Q_{23}$), a collector current of the transistor $Q_{22}$, is equal to a base current of the additional transistor $Q_{21}$. Namely, when the collector current of the transistor $Q_{22}$ and the base current of the additional transistor $Q_{21}$ are defined as $I_C(Q_{22})$ and $I_B(Q_{21})$, respectively, the following relationship is established:

$$I_B(Q_0)=I_B(Q_{21})=I_C(Q_{22})$$

Thus, since the base current $I_B(Q_0)$ of the transistor $Q_0$ flows into the collector of the transistor $Q_{22}$ without feeding into the collector of the transistor $Q_2$, the members $I_B(Q_0)$ are canceled from the aforesaid equation (29). Accordingly, the equation (31) is transformed as follows:

$$V_{REF}=V_{BE}(Q_2)+[2R_2/R_1]dV_{BE}-2\cdot R_2 I_B \quad (32)$$

Similar to the above-mentioned first embodiment, the equation (32) may be transformed as follows:

$$V_{REF}=V_{BE}(Q_2)+[2\cdot R_2/R_1]dV_{BE}-2\cdot R_2\cdot I_C/h_{fe} \quad (33)$$

Accordingly, it is possible to suitably set the resistance value $R_2$ and the collector current $I_C$ such that the following equation is established:

$$V_{BE}(Q_2)=2\cdot R_2\cdot I_C/h_{fe} \quad (34)$$

Namely, when the establishment of the equation (34) is carried by suitably setting the resistance value $R_2$ and the collector current $I_C$, the first member $V_{BE}(Q_2)$ influenced by the absolute process fluctuation (±20%) can be removed from the equation (33). Thus, it is possible to completely eliminate the influence of the absolute process fluctuation (±20%) from the output constant voltage $V_{REF}$ in the band-gap type constant voltage generating circuit shown in FIG. 4.

Although the equation (32) is identical to the equation (25) obtained in the first embodiment, these equations (32) and (25) should be distinguished from each other, because the base current $I_B(Q_0)$ of the input transistor $Q_0$ is neglected in the equation (25), whereas the base current $I_B(Q_0)$ of the input transistor $Q_0$ is canceled in the equation (32). Namely, although the influence, caused by the base current of the input transistor $Q_0$, is merely neglected in the first embodiment, that influence is completely eliminated from the output constant voltage $V_{REF}$ in this second embodiment.

Third Embodiment

Figure 5:
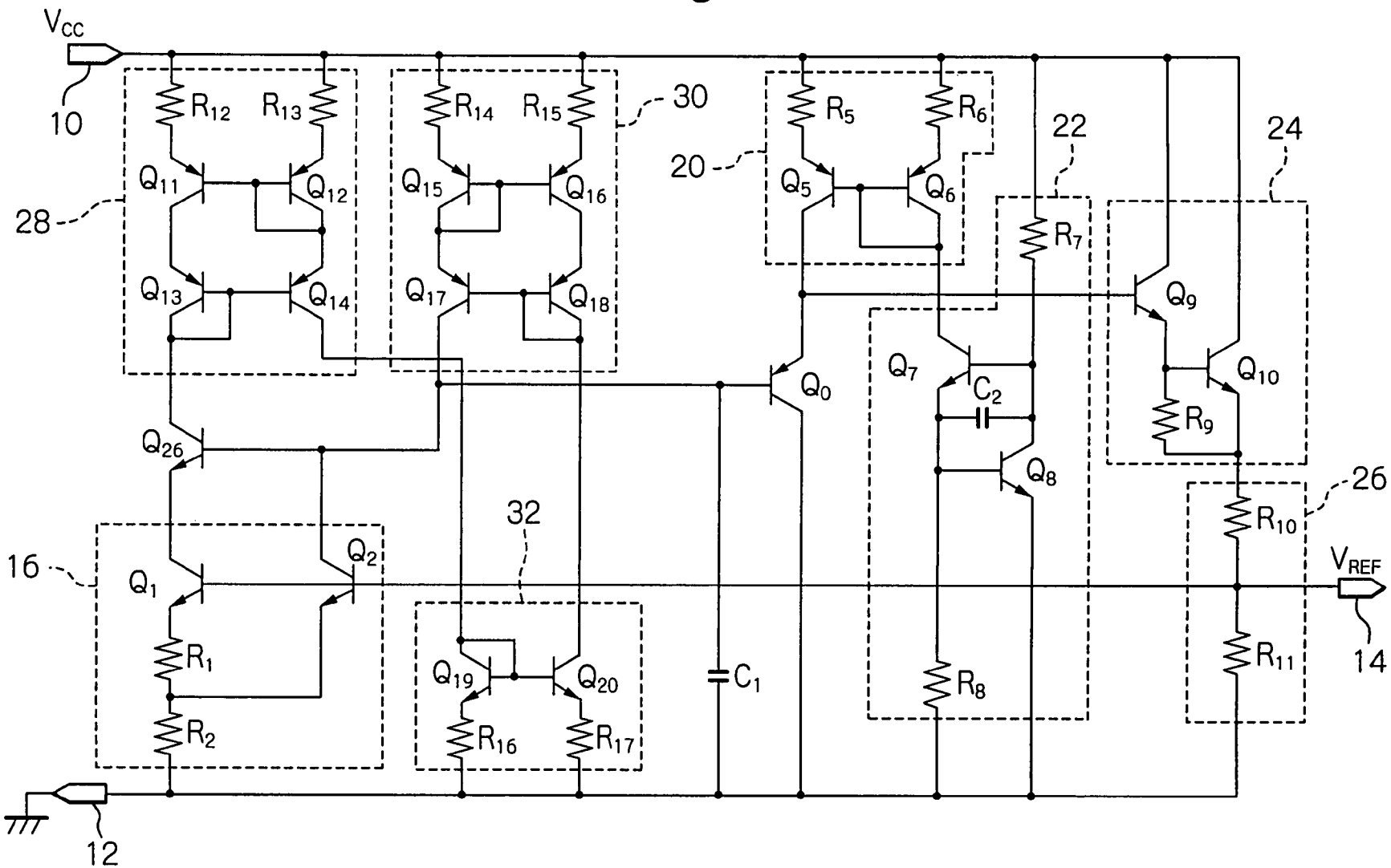
FIG. 5 is a wiring diagram of a third embodiment of a band-gap type constant voltage generating circuit according to the present invention.

With reference to FIG. 5, a third embodiment of the band-gap type constant voltage generating circuit according to the present invention will be now explained below.

As is apparent from FIG. 5, the third embodiment corresponds to the first embodiment to which an NPN type bipolar transistor $Q_{26}$ is further added. Note, in FIG. 5, the same references as in FIG. 3 represent the same features.

In particular, the transistor $Q_{26}$ features the same polarity type as that of the transistors $Q_1$ and $Q_2$ of the band-gap circuit 16. The collector of the transistor $Q_{26}$ is connected to the input terminal of the Wilson type current mirror circuit 26 (i.e., the collector of the transistor $Q_{13}$), the base of the transistor $Q_{26}$ is connected to the collector of the transistor $Q_2$, and the emitter of the transistor $Q_{26}$ is connected to the collector of the transistor $Q_1$.

In this third embodiment, the output constant voltage $V_{REF}$ is represented by the following equation:

$$\begin{aligned} V_{REF} &= V_{BE}(Q_2)+[2\cdot R_2/R_1]dV_{BE}-\alpha\cdot R_2\cdot I_B \quad (25)\\ &= V_{BE}(Q_2)+[2\cdot R_2/R_1]dV_{BE}-\alpha\cdot R_2\cdot I_C/h_{fe} \end{aligned}$$

Herein: $\alpha$ is a coefficient which is determined in dependence upon a size of the transistor $Q_{26}$, i.e. an emitter junction area of the transistor $Q_{26}$.

For example, when the emitter junction area of the transistor $Q_{26}$ is equal to those of the transistors $Q_1$, $Q_2$, $Q_{19}$ and $Q_{20}$, a base current of the transistor $Q_{26}$ may be regarded as $I_B$. In this case, the coefficient $\alpha$ is determined as 1. By suitably regulating the emitter junction area of the transistor $Q_{26}$, it is possible to optionally determine the coefficient $\alpha$. Namely, the transistor $Q_{26}$ serves as a coefficient-determination transistor for determining the coefficient $\alpha$.

Similar to the first embodiment, in the third embodiment, before the first member $V_{BE}(Q_2)$ influenced by the absolute process fluctuation (±20%) can be removed from the equation (35), it is necessary to set the resistance value $R_2$ and the collector current $I_C$ such that the following equation is established:

$$V_{BE}(Q_2)=\alpha\cdot R_2\cdot I_C/h_{fe} \quad (36)$$

According to the third embodiment, freedom of the settings of the resistance value $R_2$ and the collector current $I_C$ can be considerably improved in comparison with the first embodiment, because it is possible to optionally determine the coefficient $\alpha$ by suitably regulating the emitter junction area of the coefficient-determination transistor $Q_{26}$.

In the first embodiment, there may be a case where the settings of the resistance value $R_2$ and the collector current $I_C$ for establishing the equation (28) cannot be carried out. In this case, a coefficient of the third member $R_2\cdot I_C/h_{fe}$ of the equation (27) can be varied by regulating an emitter junction area ratio of the transistors $Q_{19}$ and $Q_{20}$ of the current mirror circuit 32, so that the settings of the resistance value $R_2$ and the collector current $I_C$ is made possible.

For example, in the first embodiment, when the transistor $Q_{20}$ features an emitter junction area twice as large as that of the transistor $Q_{19}$, the aforesaid equation (17) is modified as follows:

$$I_C(Q_{20})=I_C(Q_{14})-I_B(Q_{19})-2\cdot I_B(Q_{20})$$

Also, the aforesaid equation (27) is modified as follows:

$$V_{REF}=V_{BE}(Q_2)+[2\cdot R_2/R_1]dV_{BE}-4\cdot R_2\cdot I_C/h_{fe}$$

Namely, when the emitter junction area of the transistor $Q_{20}$ is twice as large as that of the transistor $Q_{19}$, the coefficient of the third member $R_2\cdot I_C/h_{fe}$ of the equation 27 is changed from 2 to 4.

Although the settings of the resistance value $R_2$ and the collector current $I_C$ for establishing the equation (28), i.e. $V_{BE}(Q_2)=2\cdot R_2\cdot I_C/h_{fe}$, are impossible, there may be a case where the resistance value $R_2$ and the collector current $I_C$ can be set such that the equation ($V_{BE}(Q_2)=4\cdot R_2\cdot I_C/h_{fe}$) is established.

Note, the coefficient-determination transistor $Q_{26}$ may be added to the second embodiment shown in FIG. 4, to thereby vary a coefficient of the third member $R_2\cdot I_C/h_{fe}$ of the equation (33).

In order to evaluate the present invention, first and second simulation tests were performed with respect to the first, second and third embodiments and the second prior art constant voltage generating circuit (FIG. 2) by the inventors.

In the first simulation test, it was supposed that a current amplification factor ($h_{fe}$) of each of the NPN type transistors $Q_1$, $Q_2$, $Q_{19}$ and $Q_{20}$ has been subjected to absolute process fluctuations of ±20%, and that the resistance value $R_2$ has been subjected to absolute process fluctuations of ±20%. A device influenced by the absolute process fluctuations of +20% was defined as an H-product; a device not influenced by the absolute process fluctuations (0%) was defined as an M-product; and a device influenced by the absolute process fluctuations of −20% was defined as an L-product. Also, in the first simulation test, a potential of 7 volts was applied to the maximum potential terminal 10, and a potential of the minimum potential terminal 12 was zero volts.

The second simulation test was identical to the first simulation test except that a potential of 8 volts was applied to the maximum potential terminal 10.

The results of the first and second simulation tests are shown in the following table:

| | VARIATION IN OUTPUT CONSTANT VOLTAGE $V_{REF}$ | | | | | | | |
|---|---|---|---|---|---|---|---|---|
| | 1st EMBODIMENT | | 2nd EMBODIMENT | | 3rd EMBODIMENT | | 2nd PRIOR ART | |
| MAX. P | 7 V | 8 V | 7 V | 8 V | 7 V | 8 V | 7 V | 8V |
| H-P | 1.209 V | 1.216 V | 1.207 V | 1.214 V | 1.192 V | 1.196 V | 1.234 V | 1.251 V |
| M-P | 1.215 V | 1.221 V | 1.211 V | 1.217 V | 1.198 V | 1.201 V | 1.219 V | 1.227 V |
| L-P | 1.223 V | 1.227 V | 1.213 V | 1.217 V | 1.199 V | 1.201 V | 1.224 V | 1.229 V |
| Δ | 0.014 V | 0.011 V | 0.006 V | 0.003 V | 0.007 V | 0.005 V | 0.015 V | 0.024 V |

As is apparent from this table, for example, in the first embodiment (FIG. 3), when the potential of 7 volts was applied to the maximum potential terminal 10, a constant voltage $V_{REF}$ output from the H-product (H-P) was 1.209 volts; a constant voltage $V_{REF}$ output from the M-product (M-P) was 1.215 volts; and a constant voltage $V_{REF}$ output from the L-product (L-P) was 1.223 volts. In this case, a difference Δ between the minimum constant voltage $V_{REF}$ (1.209 V) output from the H-product and the maximum constant-voltage $V_{REF}$ (1.223 V) output from the L-product was 0.014 volts.

Also, in the first embodiment (FIG. 3), when the potential of 8 volts was applied to the maximum potential terminal 10, a constant voltage $V_{REF}$ output from the H-product (H-P) was 1.216 volts; a constant voltage $V_{REF}$ output from the M-product (M-P) was 1.221 volts; and a constant voltage $V_{REF}$ output from the L-product (L-P) was 1.227 volts. In this case, a difference Δ between the minimum constant voltage $V_{REF}$ (1.216 V) output from the H-product and the maximum constant voltage $V_{REF}$ (1.227 V) output from the L-product was 0.011 volts.

In the second embodiment (FIG. 4), when the potential of 7 volts was applied to the maximum potential terminal 10, a difference Δ between the minimum constant voltage $V_{REF}$ (1.207 V) output from the H-product and the maximum constant voltage $V_{REF}$ (1.213 V) output from the L-product was 0.006 volts. Also, when the potential of 8 volts was applied to the maximum potential terminal 10, a difference Δ between the minimum constant voltage $V_{REF}$ (1.214 V) output from the H-product and the maximum constant voltage $V_{REF}$ (1.217 V) output from the L-product was 0.003 volts.

In the third embodiment (FIG. 5), when the potential of 7 volts was applied to the maximum potential terminal 10, a difference A between the minimum constant voltage $V_{REF}$ (1.192 V) output from the H-product and the maximum constant voltage $V_{REF}$ (1.199 V) output from the L-product was 0.007 volts. Also, when the potential of 8 volts was applied to the maximum potential terminal 10, a difference Δ between the minimum constant voltage $V_{REF}$ (1.196 V) output from the H-product and the maximum constant voltage $V_{REF}$ (1.201 V) output from the L-product was 0.005 volts.

On the other hand, in the second prior art constant voltage generating circuit (FIG. 2), when the potential of 7 volts was applied to the maximum potential terminal 10, a difference Δ between the minimum constant voltage $V_{REF}$ (1.219 V) output from the M-product and the maximum constant voltage $V_{REF}$ (1.234 V) output from the H-product was 0.015 volts. Also, when the potential of 8 volts was applied to the maximum potential terminal 10, a difference A between the minimum constant voltage $V_{REF}$ (1.227 V) output from the M-product and the maximum constant voltage $V_{REF}$ (1.251 V) output from the L-product was 0.024 volts.

In short, as is apparent from the above table, according to the present invention, it is found that the variation in the output constant voltage $V_{REF}$ is considerably small.

Finally, it will be understood by those skilled in the art that the foregoing description is of preferred embodiments of the device, and that various changes and modifications may be made to the present invention without departing from the spirit and scope thereof.

The invention claimed is:

1. A band-gap type constant voltage generating circuit produced in a semiconductor chip and having a first potential terminal and a second potential terminal, which circuit comprises:

a band-gap circuit including first and second transistors having respective bases connected to each other, a first resistor connected between emitters of said first and second transistors, and a second resistor connected between the emitter of said second transistor and said first potential terminal;

a constant voltage production circuit provided between said first and second potential terminals to produce and output a constant voltage based on a base-emitter voltage of the second transistor of said band-gap circuit, with the constant voltage being fed as a feedback signal to the base of the second transistor of said band-gap circuit; and a driver circuit provided between said first and second potential terminals and connected to collectors of the first and second transistors to drive said band-gap circuit, wherein said driver circuit is constituted such that an influence of absolute process fluctuation, to which said semiconductor chip is subjected during a production process thereof, is eliminated from said constant voltage.

2. The band-gap type constant voltage generating circuit as set forth in claim 1, wherein said driver circuit includes:

a current mirror circuit having an input terminal and an output terminal and connected to said first potential terminal;

a first Wilson type current mirror circuit having an input terminal and an output terminal and connected to said second potential terminal; and a second Wilson type current mirror circuit having an input terminal and an output terminal and connected to said second potential terminal, the respective collectors of the first and second transistors of said band-gap circuit being connected to the input terminal of said first Wilson type current mirror circuit and the output terminal of said second Wilson type current mirror circuit, the respective input and output terminals of said current mirror circuit being connected to the output terminal of said first Wilson type current mirror circuit and the input terminal of said second Wilson type current mirror circuit.

3. The band-gap type constant voltage generating circuit as set forth in claim 2, wherein said current mirror circuit includes third and fourth transistors having respective bases connected to each other, a third resistor connected between said first potential terminal and an emitter of said third transistor, and a fourth resistor connected between said first potential terminal and an emitter of said fourth resistor, a collector of said third transistor forming the input terminal of said current mirror circuit, a collector of said fourth transistor forming the output terminal of said current mirror circuit.

4. The band-gap type constant voltage generating circuit as set forth in claim 3, wherein said constant voltage is represented by the following equation:

$$V_{REF}=V_{BE}(Q_2)+[2\cdot R_2/R_1]dV_{BE}-2\cdot R_2\cdot I_C/h_{fe}$$

herein: $V_{REF}$ is said constant voltage; $V_{BE}(Q_2)$ is the base-emitter voltage of said second transistor; $R_2$ is a resistance value of said second resistor; $R_1$ is a resistance value of said first resistor; $dV_{BE}$ is a difference between a base-emitter voltage of said first transistor and the base-emitter voltage of said second transistor; $I_C$ is a collector current of said first, second, third and fourth transistors; and $h_{fe}$ is a current amplification factor of said first, second, third and fourth transistors, said resistance value $R_2$ and said collector current $I_C$ being set such that the following equation is established:

$$V_{BE}(Q_2)=2\cdot R_2\cdot I_C/h_{fe}.$$

5. The band-gap type constant voltage generating circuit as set forth in claim 4, wherein an emitter junction area ratio of the third and fourth transistors of said current mirror circuit is regulated to thereby vary the coefficient of the third member $R_2\cdot I_C/h_{fe}$ of said first-mentioned equation.

6. The band-gap type constant voltage generating circuit as set forth in claim 3, wherein there is provided a coefficient-determination transistor between the collector of said first transistor of said band-gap circuit and the input terminal of said first Wilson type current mirror circuit, a collector of said coefficient-determination transistor being connected to the input terminal of said first Wilson type current mirror circuit, a base of said coefficient-determination transistor being connected to the collector of the second transistor of said band-gap circuit, an emitter of said coefficient-determination transistor being connected to the collector of the second transistor of said band-gap circuit, and wherein said constant voltage is represented by the following equation:

$$V_{REF}=V_{BE}(Q_2)+[2\cdot R_2/R_1]dV_{BE}-\alpha\cdot R_2\cdot I_C/h_{fe}$$

herein: $V_{REF}$ is said constant voltage; $V_{BE}(Q_2)$ is the base-emitter voltage of said second transistor; $R_2$ is a resistance value of said second resistor; $R_1$ is a resistance value of said first resistor; $dV_{BE}$ is a difference between a base-emitter voltage of said first transistor and the base-emitter voltage of said second transistor; $I_C$ is a collector current of said first, second, third and fourth transistors; $h_{fe}$ is a current amplification factor of said first, second, third and fourth transistors, and $\alpha$ is a coefficient determined in dependence upon an emitter junction area of said coefficient-determination transistor, said resistance value $R_2$ and said collector current $I_C$ being set such that the following equation is established:

$$V_{BE}(Q_2)=\alpha\cdot R_2\cdot I_C/h_{fe}.$$

7. The band-gap type constant voltage generating circuit as set forth in claim 6, wherein an emitter junction area ratio of the third and fourth transistors of said current mirror circuit is regulated to thereby vary the coefficient $\alpha$ of the third member $R_2\cdot I_C/h_{fe}$ of said first-mentioned equation.

8. The band-gap type constant voltage generating circuit as set forth in claim 4, wherein said constant voltage production circuit includes an input transistor having a base for receiving the base-emitter voltage of the second transistor of said band-gap transistor, and a transistor associated with said input transistor as an additional transistor, and a third Wilson type current mirror circuit are provided to thereby eliminate an influence, caused by a base current of said input transistor, from said first-mentioned equation.

9. The band-gap type constant voltage generating circuit as set forth in claim 8, wherein said third Wilson type current mirror circuit has an input terminal and an output terminal and is connected to said first potential terminal, the output and input terminals of said third Wilson type current mirror circuit being connected to the respective bases of said input and additional transistors, a collector of said input transistor being connected to an emitter of said additional transistor, a collector of said additional transistor being connected to said first potential terminal.

10. The band-gap type constant voltage generating circuit as set forth in claim 9, wherein an emitter junction area ratio of the third and fourth transistors of said current mirror circuit is regulated to thereby vary the coefficient of the third member $R_2 \cdot I_C/h_{fe}$ of said first-mentioned equation.

11. The band-gap type constant voltage generating circuit as set forth in claim 6, wherein said constant voltage production circuit includes an input transistor having a base for receiving the base-emitter voltage of the second transistor of said band-gap transistor, and a transistor associated with said input transistor as an additional transistor, and a third Wilson type current mirror circuit are provided to thereby eliminate an influence, caused by a base current of said sixth transistor, from said equation.

12. The band-gap type constant voltage generating is circuit as set forth in claim 11, wherein said third Wilson type current mirror circuit has an input terminal and an output terminal and is connected to said first potential terminal, the output and input terminals of said third Wilson type current mirror circuit being connected to the respective bases of said input and additional transistors, a collector of said input transistor being connected to an emitter of said additional transistor, a collector of said additional transistor being connected to said first potential terminal.

13. The band-gap type constant voltage generating circuit as set forth in claim 12, wherein an emitter junction area ratio of the third and fourth transistors of said current mirror circuit is regulated to thereby vary the coefficient $\alpha$ of the third member $R_2 \cdot I_C/h_{fe}$ of said first-mentioned equation.

14. The band-gap type constant voltage generating circuit of claim 1, wherein said absolute process fluctuation is eliminated by a setting of a predetermined operating current.

15. The band-gap type constant voltage generating circuit of claim 1, wherein said absolute process fluctuation comprises a variation that occurs between two substantially identical elements located remotely from each other on said semiconductor chip.

16. A band-gap type constant voltage generating circuit, comprising:

a band-gap circuit including first and second transistors having respective bases connected to each other; and a driver circuit connected to collectors of the first and second transistors to drive said band-gap circuit, said band-gap circuit and said driver circuit being fabricated on a semiconductor chip, wherein said driver circuit is constituted such that an influence of absolute process fluctuation to which said semiconductor chip is subjected during a production process thereof is reduced or substantually eliminated.

17. The band-gap type constant voltage generating circuit of claim 16, wherein said absolute process fluctuation is reduced or substantially eliminated by a setting of a predetermined operating current.

18. A method of at least reducing an influence of an absolute process fluctuation to which a semiconductor chip is subjected during a production process thereof for a chip including a band-gap type constant voltage generating circuit, said method comprising:

constituting a driver connected to said band-gap type constant voltage generating circuit to have an operating current predetermined to have said effect of reducing or substantially eliminating said absolute process fluctuation influence.

19. The method of claim 18, wherein said band-gap circuit comprises:

first and second transistors having respective bases connected to each other, a first resistor connected between emitters of said first and second transistors, and a second resistor connected between the emitter of said second transistor and said first potential terminal;

a constant voltage production circuit provided between said first and second potential terminals to produce and output a constant voltage based on a base-emitter voltage of the second transistor of said band-gap circuit, with the constant voltage being fed as a feedback signal to the base of the second transistor of said band-gap circuit; and a driver circuit provided between said first and second potential terminals and connected to collectors of the first and second transistors to drive said band-gap circuit, wherein said driver circuit is constituted such that the influence of an absolute process fluctuation is reduced or substantially eliminated from said constant voltage by adjusting an operating current for said driver circuit.

20. The method of claim 19, wherein said operating current is determined in accordance with $V_{REF}=V_{BE}(Q_2)+[2 \cdot R_2/R_1]dV_{BE}-\alpha \cdot R_2 \cdot I_C/h_{fe}$ wherein: $V_{REF}$ is a constant voltage provided by said band-gap type constant voltage generating circuit; $V_{BE}(Q_2)$ is a base-emitter voltage of said second transistor; $R_2$ is a resistance value of said second resistor; $R_1$ is a resistance value of said first resistor; $dV_{BE}$ is a difference between a base-emitter voltage of said first transistor and the base-emitter voltage of said second transistor; $I_C$ is a collector current of said first and second transistors; $h_{fe}$ is a current amplification factor of said first and second transistors, and $\alpha$ is a coefficient determined in dependence upon an emitter junction area of a coefficient-determination transistor, said resistance value $R_2$ and said collector current $I_C$ being set such that the following equation is established:

$$V_{BE}(Q_2)=\alpha \cdot R_2 \cdot I_C/h_{fe}.$$

21. The band-gap type constant voltage generating circuit of claim 16, wherein a fluctuation in a base-emitter voltage ($V_{BE}(Q_2)$) of said second transistor is eliminated by a current amplification factor ($h_{fe}$) of said first and second transistors.

* * * * *